US012796767B2

(12) United States Patent
Berrian et al.

(10) Patent No.: US 12,796,767 B2
(45) Date of Patent: Nov. 17, 2026

(54) RADIALLY KNITTED COMPONENTS WITH INTEGRAL TONGUE ELEMENTS, UPPERS AND ARTICLES OF FOOTWEAR WITH THE SAME, AND METHODS OF MANUFACTURING THE SAME

(71) Applicant: NIKE, Inc., Beaverton, OR (US)

(72) Inventors: Travis J. Berrian, Portland, OR (US); Gagandeep Singh, Haeundae-gu (KR)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 19/353,530

(22) Filed: Oct. 8, 2025

(65) Prior Publication Data

US 2026/0101956 A1 Apr. 16, 2026

Related U.S. Application Data

(60) Provisional application No. 63/707,104, filed on Oct. 14, 2024.

(51) Int. Cl.
*A43B 1/04* (2022.01)
*D04B 1/24* (2006.01)

(52) U.S. Cl.
CPC ..... *A43B 1/04* (2013.01); *D04B 1/24* (2013.01); *D10B 2501/043* (2013.01)

(58) Field of Classification Search
CPC ..... A43B 1/04; A43B 23/26; A43B 23/025; A43B 23/0265; A43B 23/045; D10B 2501/043
See application file for complete search history.

(56) References Cited

U.S. PATENT DOCUMENTS 1,407,661 A * 2/1922 Kenton ..... A43B 23/025 36/45
2,047,724 A 7/1936 Zuckerman
(Continued)

FOREIGN PATENT DOCUMENTS

CN 103494401 A 1/2014
CN 105050442 A 11/2015
(Continued)

OTHER PUBLICATIONS

Non-Final Office Action received for U.S. Appl. No. 19/208,450, mailed on Apr. 20, 2026, 7 pages.
(Continued)

*Primary Examiner* — Jillian K Pierorazio
(74) *Attorney, Agent, or Firm* — Shook, Hardy & Bacon L.L.P.

(57) ABSTRACT

Radially knitted components, uppers, and articles of footwear with the same, and methods of manufacturing the same. Radially knitted components can be formed to include integral tongue elements, e.g., formed during a knitting process that produces a plurality of radially knitted courses integrated with other parts of the knitted component. The knitted component can have a substantially curved geometry in a flat configuration, such that the integral tongue elements overlap. The integral tongue elements can be joined together to produce a tongue structure of an upper for an article of footwear, allowing footwear formed of radially knitted components to include an integrated tongue. In addition, a dimensionally and structurally beneficial tongue can be provided with reduced reliance on post-processing operations, among other benefits.

29 Claims, 9 Drawing Sheets

(56) References Cited

U.S. PATENT DOCUMENTS

| | | | | |
|---|---|---|---|---|
| 2,222,946 | A | 11/1940 | Hall | |
| 2,247,459 | A * | 7/1941 | Wolfhard | A43B 23/025 36/52 |
| 2,400,692 | A | 5/1946 | Herbert | |
| 2,618,139 | A | 11/1952 | Silman | |
| 3,141,318 | A | 7/1964 | Griffith | |
| 3,796,068 | A | 3/1974 | Betts et al. | |
| 3,924,423 | A | 12/1975 | Lonati | |
| 3,992,903 | A | 11/1976 | Janda et al. | |
| 4,041,736 | A | 8/1977 | Fregeolle | |
| 4,149,323 | A * | 4/1979 | Roy | A43B 23/0295 36/48 |
| 4,422,307 | A | 12/1983 | Thorneburg | |
| 8,959,959 | B1 | 2/2015 | Podhajny | |
| 8,997,529 | B1 | 4/2015 | Podhajny | |
| 9,078,488 | B1 | 7/2015 | Meir et al. | |
| 9,713,363 | B2 | 7/2017 | Dojan | |
| 10,398,196 | B2 | 9/2019 | Minami et al. | |
| 11,168,416 | B2 | 11/2021 | Huffa et al. | |
| 2004/0118018 | A1 | 6/2004 | Dua | |
| 2005/0081402 | A1* | 4/2005 | Orei | A43B 1/00 36/45 |
| 2005/0115284 | A1 | 6/2005 | Dua | |
| 2008/0110048 | A1 | 5/2008 | Dua et al. | |
| 2012/0233882 | A1 | 9/2012 | Huffa et al. | |
| 2014/0245633 | A1 | 9/2014 | Podhajny | |
| 2014/0245634 | A1 | 9/2014 | Podhajny | |
| 2015/0059209 | A1 | 3/2015 | Dekovic et al. | |
| 2015/0075031 | A1 | 3/2015 | Podhajny et al. | |
| 2015/0216254 | A1 | 8/2015 | Podhajny | |
| 2015/0216256 | A1 | 8/2015 | Podhajny | |
| 2015/0272274 | A1* | 10/2015 | Berns | A43B 23/0205 36/84 |
| 2015/0289592 | A1 | 10/2015 | Song | |
| 2015/0351483 | A1 | 12/2015 | Podhajny | |
| 2016/0029736 | A1 | 2/2016 | Meir | |
| 2016/0038346 | A1 | 2/2016 | Collins et al. | |
| 2016/0058099 | A1 | 3/2016 | Panian et al. | |
| 2016/0058100 | A1 | 3/2016 | Dealey et al. | |
| 2016/0088899 | A1 | 3/2016 | Liles et al. | |
| 2016/0174660 | A1 | 6/2016 | Iuchi et al. | |
| 2016/0255913 | A1 | 9/2016 | Uchikawa et al. | |
| 2016/0302527 | A1* | 10/2016 | Meir | A43B 23/0245 |
| 2016/0331083 | A1 | 11/2016 | Uesato | |
| 2016/0366978 | A1 | 12/2016 | Holt | |
| 2016/0366980 | A1 | 12/2016 | Bell et al. | |
| 2017/0035149 | A1 | 2/2017 | Bruce et al. | |
| 2017/0202295 | A1 | 7/2017 | Macgilbert et al. | |
| 2017/0245582 | A1* | 8/2017 | Green | D04B 1/16 |
| 2017/0325547 | A1 | 11/2017 | Cai et al. | |
| 2018/0132487 | A1* | 5/2018 | Kormann | A43B 1/02 |
| 2018/0132558 | A1 | 5/2018 | Berrian et al. | |
| 2018/0317592 | A1 | 11/2018 | Rudolf et al. | |
| 2018/0317593 | A1* | 11/2018 | Dealey | A43B 1/04 |
| 2019/0037968 | A1 | 2/2019 | Dewillie et al. | |
| 2019/0116914 | A1 | 4/2019 | Schoppel et al. | |
| 2019/0166951 | A1 | 6/2019 | Holt | |
| 2019/0223540 | A1 | 7/2019 | Cox et al. | |
| 2019/0223541 | A1 | 7/2019 | Aceves et al. | |
| 2019/0231030 | A1 | 8/2019 | Uesato | |
| 2019/0274392 | A1 | 9/2019 | Amis et al. | |
| 2019/0365049 | A1 | 12/2019 | Verfl | |
| 2020/0022456 | A1 | 1/2020 | Brinkman et al. | |
| 2020/0029655 | A1 | 1/2020 | Nishiwaki et al. | |
| 2020/0046074 | A1* | 2/2020 | Berrian | A43B 23/0205 |
| 2020/0163414 | A1* | 5/2020 | Meir | A43B 23/0245 |
| 2020/0170326 | A1 | 6/2020 | Furuya | |
| 2020/0288814 | A1 | 9/2020 | Chang et al. | |
| 2020/0397091 | A1 | 12/2020 | Cox et al. | |
| 2022/0256962 | A1 | 8/2022 | Dekovic et al. | |
| 2022/0259780 | A1 | 8/2022 | Green et al. | |
| 2023/0323574 | A1 | 10/2023 | Mcfarland et al. | |
| 2024/0271342 | A1 | 8/2024 | Dittmann et al. | |
| 2025/0176656 | A1 | 6/2025 | Poegl et al. | |
| 2025/0270745 | A1* | 8/2025 | Brown | A43B 1/04 |
| 2026/0071359 | A1* | 3/2026 | Dua | D04B 1/24 |

FOREIGN PATENT DOCUMENTS

| | | | |
|---|---|---|---|
| CN | 106037148 | A | 10/2016 |
| CN | 205831190 | U | 12/2016 |
| CN | 206197216 | U | 5/2017 |
| CN | 207341288 | U | 5/2018 |
| CN | 109963477 | A | 7/2019 |
| CN | 210169187 | U | 3/2020 |
| CN | 111549434 | A | 8/2020 |
| CN | 111601920 | A | 8/2020 |
| CN | 113331530 | A | 9/2021 |
| CN | 113367448 | A | 9/2021 |
| CN | 113403735 | A | 9/2021 |
| CN | 110013069 | B | 10/2021 |
| CN | 219500511 | U | 8/2023 |
| EP | 2199444 | A1 | 6/2010 |
| EP | 2759625 | A2 | 7/2014 |
| EP | 3123889 | A1 | 2/2017 |
| EP | 4298946 | A1 | 1/2024 |
| GB | 0547900 | A | 9/1942 |
| GB | 0661947 | A | 11/1951 |
| GB | 1149724 | A | 4/1969 |
| GB | 2121078 | A | 12/1983 |
| JP | 2016-516458 | A | 6/2016 |
| JP | 2016-529036 | A | 9/2016 |
| JP | 2017-522129 | A | 8/2017 |
| JP | 2018-521808 | A | 8/2018 |
| TW | I520690 | B | 2/2016 |
| TW | 201636470 | A | 10/2016 |
| TW | 201726014 | A | 8/2017 |
| TW | 1601487 | B | 10/2017 |
| TW | 202042692 | A | 12/2020 |
| TW | 202118410 | A | 5/2021 |
| TW | 202207832 | A | 3/2022 |
| TW | 202216001 | A | 5/2022 |
| WO | 2014/137826 | A1 | 9/2014 |
| WO | 2016/018904 | A1 | 2/2016 |
| WO | 2016/168046 | A2 | 10/2016 |
| WO | 2018/031616 | A1 | 2/2018 |
| WO | 2023/069764 | A2 | 4/2023 |

OTHER PUBLICATIONS

Non-Final Office Action received for U.S. Appl. No. 19/285,536, mailed on Apr. 8, 2026, 11 pages.

International Search Report received from PCT Patent Application No. PCT/US2025/050296, mailed on Feb. 16, 2026, 15 pages.

Final Office Action received for U.S. Appl. No. 19/285,536, mailed on Sep. 16, 2026, 10 pages.

Non-Final Office Action received for U.S. Appl. No. 19/388,560, mailed on Jul. 27, 2026, 13 pages.

* cited by examiner

RADIALLY KNITTED COMPONENTS WITH INTEGRAL TONGUE ELEMENTS, UPPERS AND ARTICLES OF FOOTWEAR WITH THE SAME, AND METHODS OF MANUFACTURING THE SAME

CROSS-REFERENCE TO RELATED APPLICATIONS AND PRIORITY CLAIM

This non-provisional patent application claims priority to U.S. provisional patent app. No. 63/707,104, filed on Oct. 14, 2024, and titled "RADIALLY KNITTED COMPONENTS WITH INTEGRAL TONGUE ELEMENTS, UPPERS AND ARTICLES OF FOOTWEAR WITH THE SAME, AND METHODS OF MANUFACTURING THE SAME," the contents of which is incorporated herein by reference in the entirety.

TECHNICAL FIELD

The field relates to knitted components for footwear.

INTRODUCTION

Uppers for footwear are often formed with knitted components. Knitted components have beneficial characteristics such as stretch, comfort, and adaptability to conform to the shape of a wearer's foot. Knitted components can be formed through different processes, e.g., weft knitting, warp knitting, or the like. In some instances, knitted components can be formed with radial knitting which produces a knitted component with knitted courses extending in a radiating pattern, or rather, extending in non-parallel orientations. However, integrally knitting certain structures into an upper using radial knitting can be challenging.

SUMMARY

In brief, and at a high-level, this disclosure describes, among other things, radially knitted components for footwear, uppers and articles of footwear with the same, and methods of manufacturing the same, among other things.

In aspects, radially knitted components include integral tongue elements. The integral tongue elements can be formed during a knitting process that produces other portions of the radially knitted component for an upper of an article of footwear. The integral tongue elements can, subsequent to a knitting process, be manipulated, e.g., connected together, to form a tongue.

In aspects, a knitted component includes a plurality of radially knitted courses extending between an inner perimeter edge and an outer perimeter edge. Tongue elements are formed as an integral extension of a portion of the plurality of radially knitted courses. Each tongue element defines part of the inner perimeter edge. The tongue elements are formed so that in a flat configuration of the knitted component, the tongue elements extend towards each other and/or overlap and/or intersect. The tongue elements can be attached together at a connection to form the tongue. The connection can be formed with stitching, welding, bonding, adhesive, thermoforming fusible materials, folding or overlays, or another suitable attachment method. The shape, size, and/or overlapping configuration of the tongue elements can be adjusted or tuned to allow the tongue to form a desired geometry in the connected state. The aspects herein provide a tongue for an upper that unexpectedly and beneficially extends, projects, and/or curves upward and outward, producing a more desirable shape, fit, and aesthetic appearance in an article of footwear, among other benefits.

In aspects herein, an upper includes a radially knitted component with integral tongue elements that are connected together to form a tongue.

In aspects herein, an article of footwear includes an upper formed with a radially knitted component that includes integral tongue elements that are connected together to form a tongue.

In aspects herein, methods of manufacturing knitted components, uppers, and articles of footwear are provided.

In aspects herein, methods of producing an array of articles of footwear that each include an upper formed with a radially knitted component with integrally formed tongue elements are provided.

The knitted components, uppers, articles of footwear, and methods of manufacturing the same described herein can provide a range of benefits. For example, by forming integral tongue elements during a knitting process that produces a radially knitted component, more integrally formed and structurally beneficial knitted components can be produced. In addition, the need for post-processing manipulation can also be reduced or limited, which can increase efficiency, reduce complexity, and reduce waste, and thereby increase sustainability in footwear manufacturing, among other benefits.

This summary is intended to introduce a selection of concepts in a simplified form which are further described below in the detailed description section of this disclosure. This summary is not intended to identify key or essential features of the claimed subject matter, nor is it intended to be used as an aid in isolation to determine the scope of the claimed subject matter.

BRIEF DESCRIPTION OF THE DRAWINGS

The knitted components, uppers, and articles of footwear with integral tongue elements, and methods of manufacturing the same described herein, are discussed in detail in connection with the attached figures illustrating non-limiting examples of the present subject matter, wherein.

DETAILED DESCRIPTION

In general, this disclosure describes, among other things, knitted components formed using radial knitting techniques. The knitted components can be formed to include integral tongue elements. The integral tongue elements can be connected together to form an integral tongue of an upper of an article of footwear. The formation of integral tongue elements during a radial knitting process used to produce other parts of a knitted component can allow an integral tongue and/or elements thereof to be produced with reduced reliance on post-processing operations, and can allow a more integral, co-extensive, and seamless upper and corresponding article of footwear to be produced. Forming integral tongue elements can help reduce the complexity and time required for footwear manufacturing, thus increasing efficiency and sustainability. In addition, uppers produced with the integral tongue elements described herein can provide a tongue with more desirable properties, e.g., dimensional, geometric, and/or aesthetic properties, among other benefits. Examples of aspects herein are described below in connection with attached FIGS. 1-7.

Figure 1:
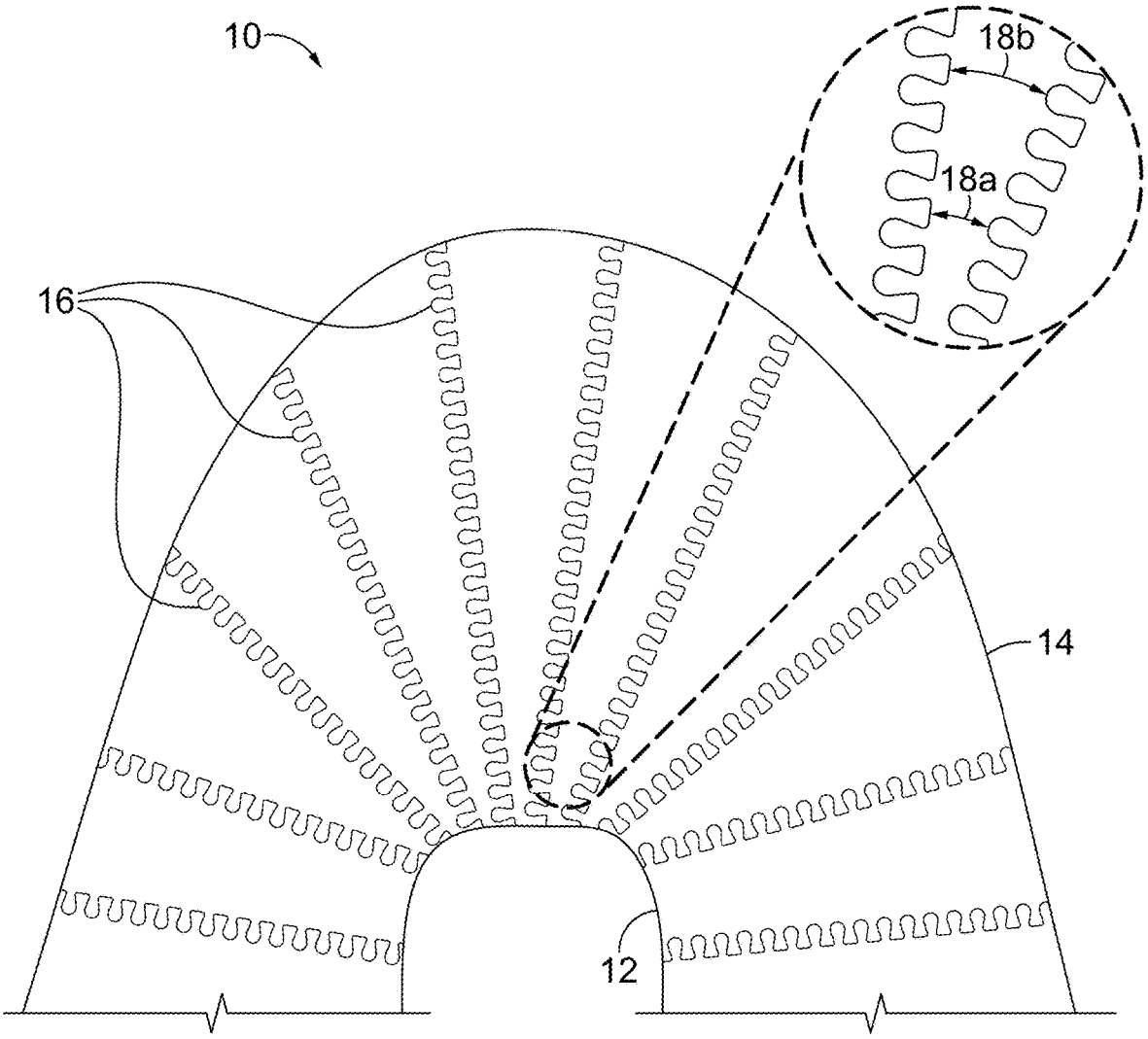
FIG. 1 depicts a knitted component formed using a radial knitting technique, in accordance with aspects herein.

Looking now at FIG. 1, a knitted component 10 is shown, in accordance with aspects of the present disclosure. The knitted component 10 includes an inner perimeter edge 12 and an outer perimeter edge 14. The knitted component 10 further includes a plurality of radially knitted courses 16 extending between the inner perimeter edge 12 and the outer perimeter edge 14. In this example, the knitted component 10 is formed using a radial knitting technique that sequentially produces the plurality of radially knitted courses 16 that extend from the inner perimeter edge 12 to the outer perimeter edge 14. The plurality of radially knitted courses 16 are formed such that the courses radiate outward from a common portion, e.g., in this case, the inner perimeter edge 12. In FIG. 1, it can be seen that the radially knitted courses 16 extend at least partially at an angle to each other. To state it differently, a spacing between adjacent radially knitted courses, e.g., spacings 18*a*, 18*b* as identified in FIG. 1, increases as the plurality of radially knitted courses 16 transition from inner perimeter edge 12 to the outer perimeter edge 14, as in FIG. 1.

Figure 2:
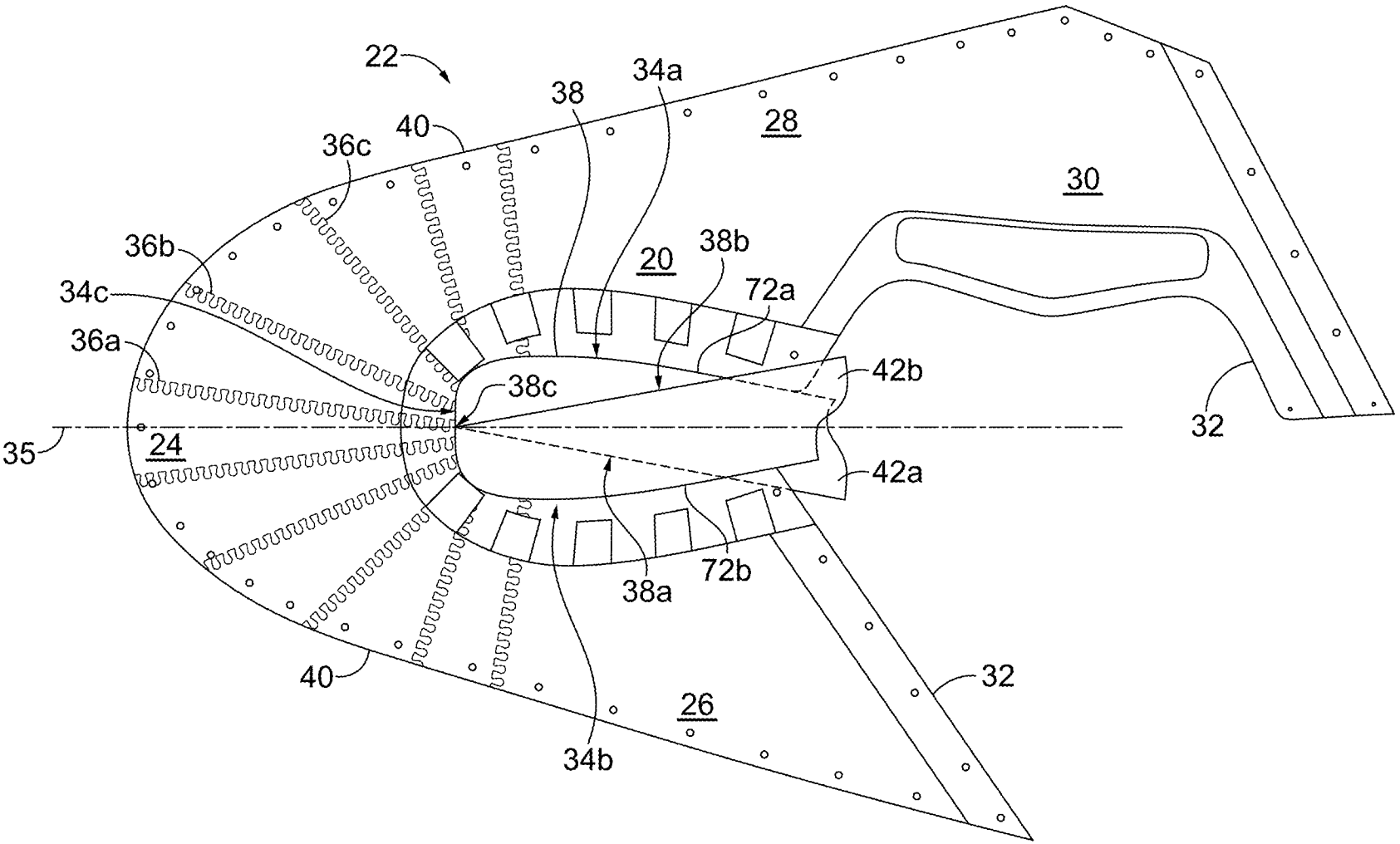
FIG. 2 depicts an upper formed with a radially knitted component that includes integral tongue elements, in accordance with aspects herein.

Looking now at FIG. 2, a radially knitted component 20 forming at least part of an upper 22 for an article of footwear is shown, in accordance with aspects of the present disclosure. The upper 22 includes a toe portion 24, a side portion 26 (e.g., medial or lateral side), a side portion 28 (e.g., medial or lateral side), a heel portion 30, a collar portion 32, and a throat portion 34. The throat portion 34 includes a side 34*a*, a side 34*b*, and a side 34*c*. The upper 22 shown in FIG. 2 is intended to represent one possible configuration of an upper incorporating elements of the present disclosure. In this example, the upper 22 is configured for assembly with a side seam. However, many other configurations of an upper, e.g., including those with an integral construction or assembled construction, are contemplated herein. FIG. 2 is intended to represent one non-limiting example.

Figure 4A:
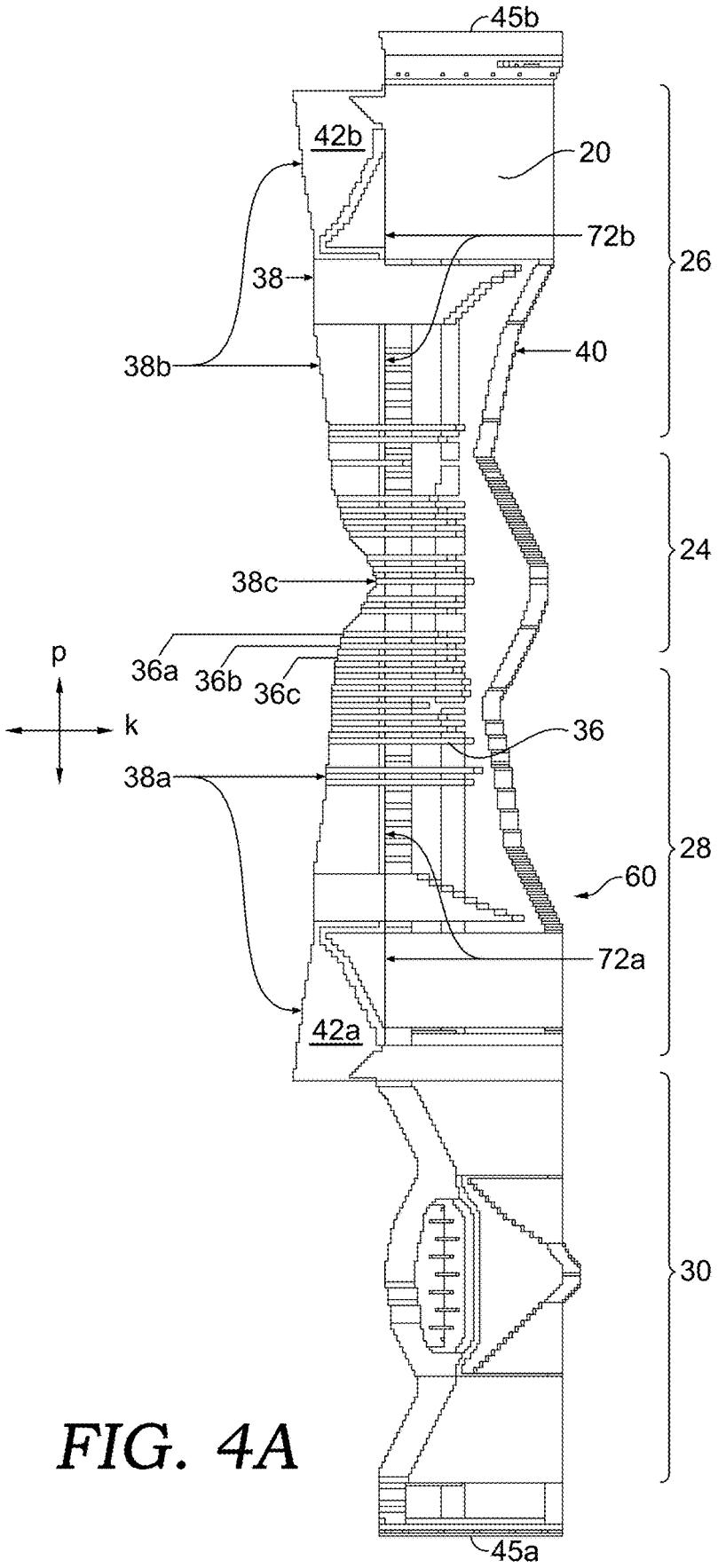
FIGS. 4A and 4B each depict a bitmap representing a configuration of a radially knitted component as it is produced using a knitting machine, in accordance with aspects herein.
Figure 4B:
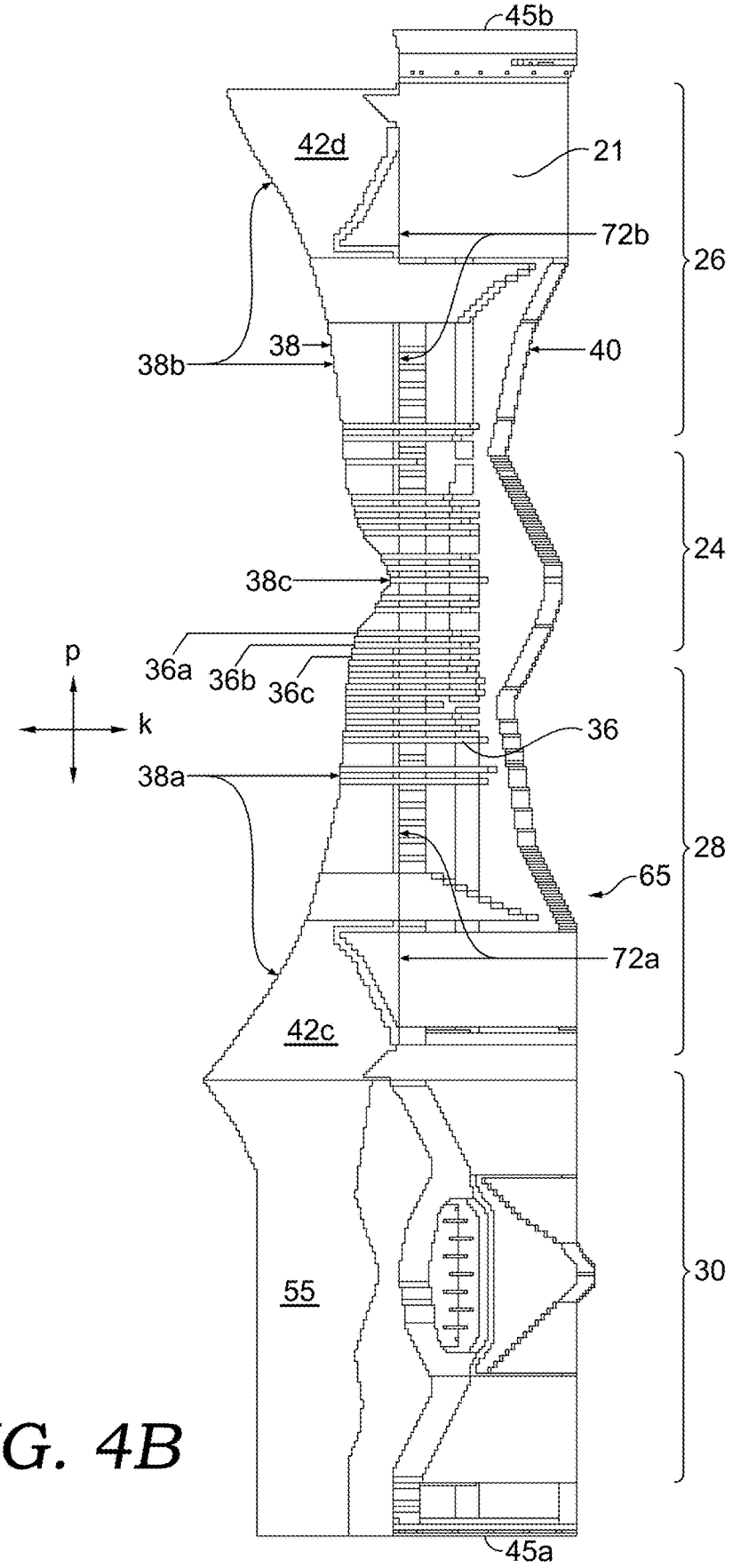

The knitted component 20 is formed with a radial knitting technique. For example, using a programmable knitting machine, a plurality of radially knitted courses, e.g., 36*a*, 36*b*, etc., are knitted in a sequential fashion. Only some of the radially knitted courses 36 are identified in FIG. 2 for clarity purposes. The radially knitted courses 36 are formed such that each radially knitted course 36 extends from an inner perimeter edge 38 of the upper 22 to an outer perimeter edge 40 of the upper 22. The inner perimeter edge 38 includes inner perimeter edges 38*a*, 38*b*, 38*c* that can be integrally co-extensive, e.g., formed as part of a common knit structure, e.g., with interlooped yarns. The radially knitted courses 36 extend outward from the inner perimeter edge 38, e.g., from edges 38*a* or 38*b* or 38*c*, at an angle to each other, such that a spacing between the radially knitted courses 36 increases as the courses transition toward the outer perimeter edge 40 as described in connection with FIG. 1. The radiating pattern of the knitted courses 36 can impart a range of benefits to the upper 22. For example, the radiating knitted courses 36 can increase foot containment, lateral support, and lockdown; can create a unique visual pattern, e.g., particularly in combination with visually-distinguishable yarns; and can allow an integrally-knit upper to be formed in a more compact knitting space on a knitting machine (e.g., the maximum width of the knitting space generally only needs to correspond to the largest distance between the inner and outer perimeter edges 38, 40). FIG. 2 depicts the knitted component 20 produced and in a flat configuration. FIG. 4A depicts a bitmap 60 of the knitted component 20 that is used by a knitting machine to produce the knitted component 20. The bitmap 60 is described in detail in connection with FIG. 4A. FIG. 4B depicts a different bitmap 65 associated with a different configuration of a knitted component 21 which includes an ankle cuff or bootie configured to extend higher for greater coverage and/or enclosure of a wearer's ankle.

The radially knitted component 20 is formed such that it includes integral tongue elements, e.g., integral tongue elements 42*a*, 42*b*. The integral tongue elements 42*a*, 42*b* are at least partially integrally knitted with other portions of the knitted component 20. In particular, as shown in FIG. 2, the integral tongue elements 42*a*, 42*b* are formed such that the integral tongue elements 42*a*, 42*b* are integrally co-extensive with the portions 24 and/or 26 and/or 28 of the knitted component 20. The integral tongue elements 42*a*, 42*b* extend towards the correspondingly opposite side 26 or 28, e.g., across a centerline 35, so as to be overlapping, as shown in FIG. 2. To state it differently, the radially knitted component 20 is formed such that in a flat configuration, e.g., as shown in FIG. 2, the integral tongue elements 42*a*, 42*b* intersect and overlap each other. This overlapping configuration supports formation of a desired dimensional tongue shape once the integral tongue elements 42*a*, 42*b* are connected together and in an article of footwear, e.g., as shown in the non-limiting example of FIGS. 3A and 3B.

Figure 3A:
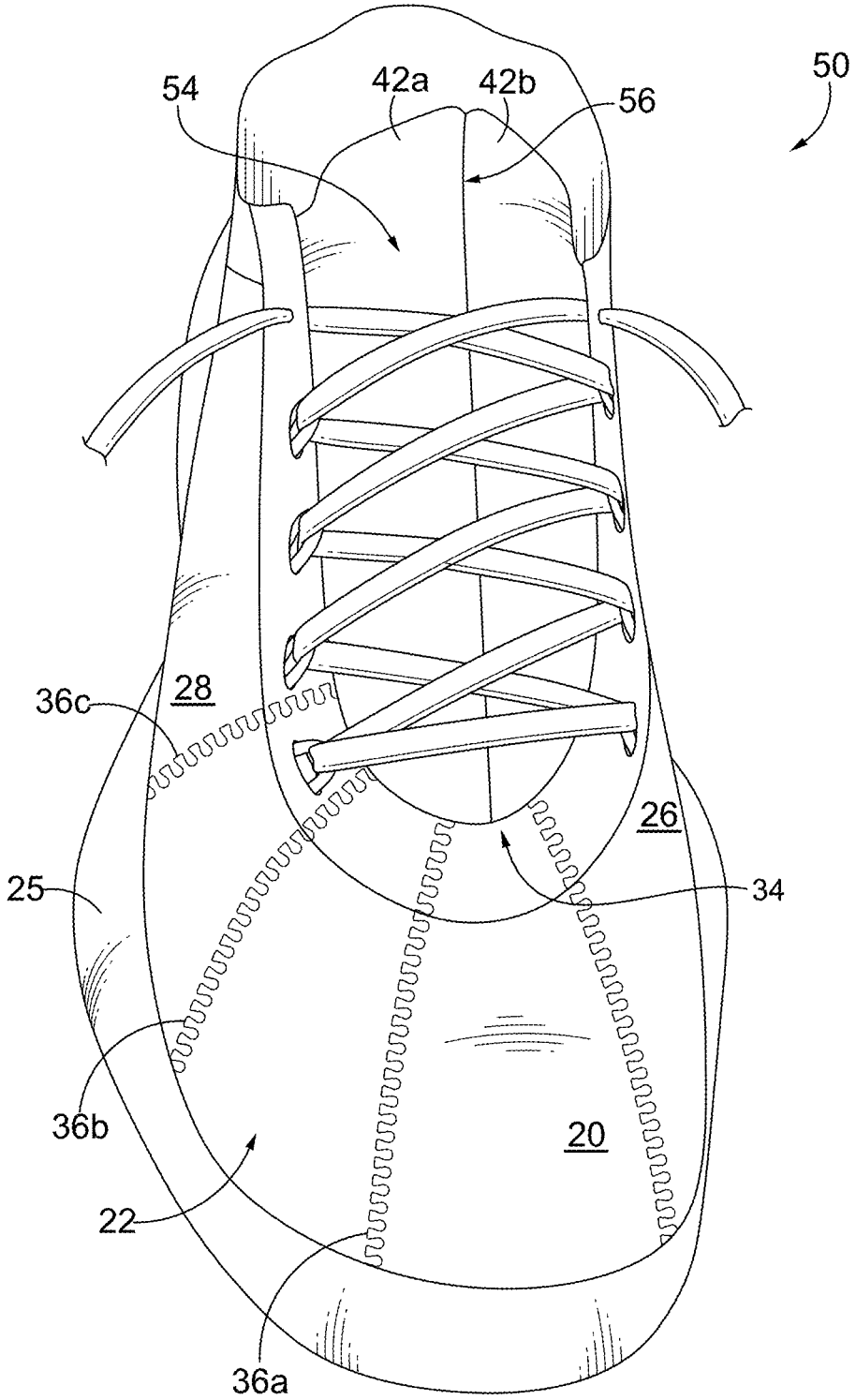
FIGS. 3A and 3B depict the upper of FIG. 2 incorporated into an article of footwear with the integral tongue elements connected together to form a tongue, in accordance with aspects herein.
Figure 3B:
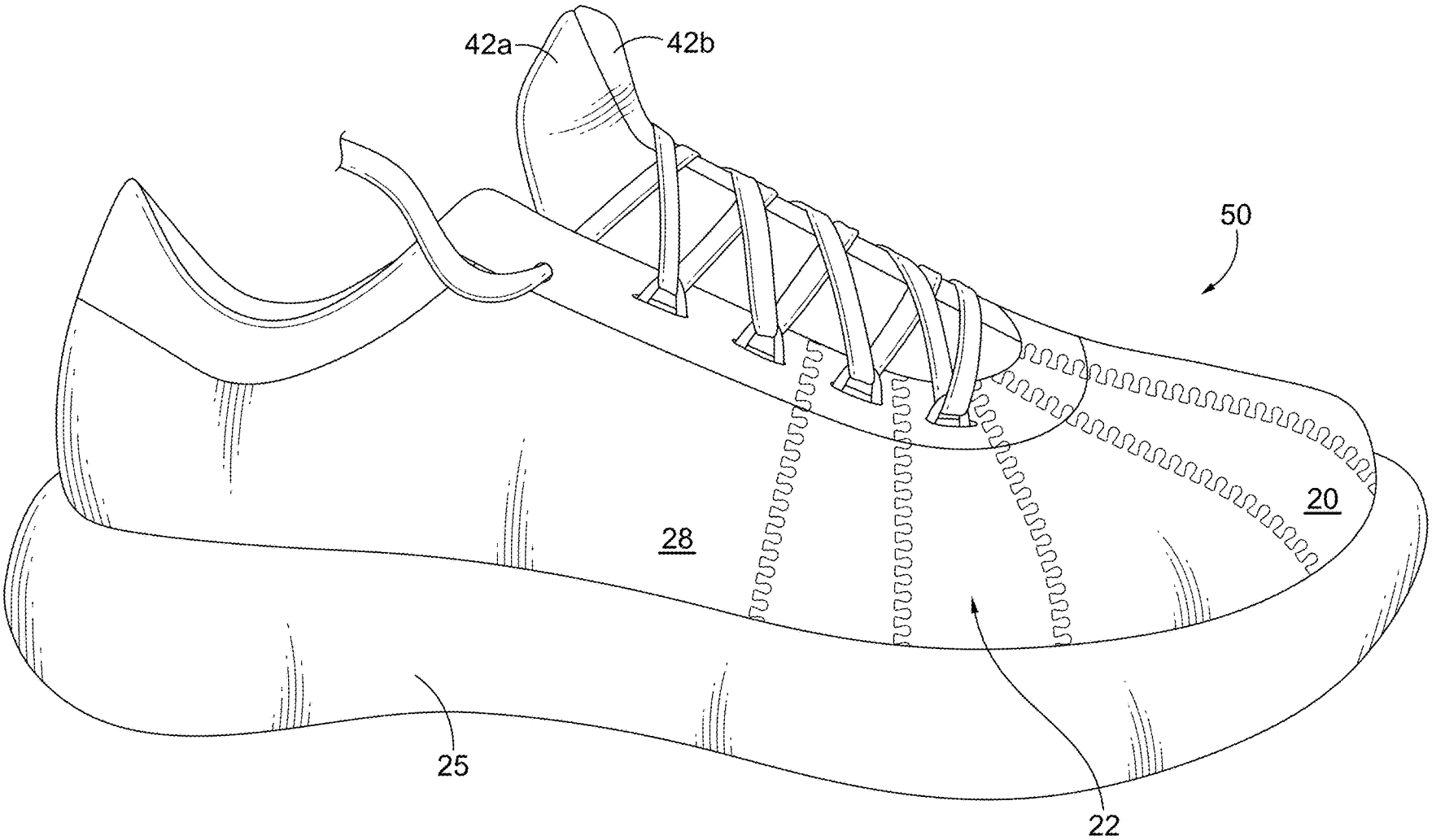

Looking now at FIGS. 3A and 3B, the upper 22 of FIG. 2 integrated into an article of footwear 50, with the integral tongue elements 42*a*, 42*b* of the knitted component 20 connected together to form at least part of a tongue 54, are shown, in accordance with aspects of the present disclosure. In FIGS. 3A and 3B, the upper 22 is attached to a sole structure 25. FIG. 3A depicts a first perspective of the article of footwear 50, e.g., looking toward the throat and tongue, e.g., generally along the centerline 35 of FIG. 2. FIG. 3B is looking at a lateral side of the article of footwear 50, e.g., generally perpendicular to the centerline 35 of FIG. 2.

FIGS. 3A and 3B depict the throat portion 34 with the integral tongue elements 42*a*, 42*b* connected at the connection 56 to form the tongue 54. In this aspect, the tongue 54 integrally extends from the portions 24, 26, 28 of the knitted component 20. The connection 56 represents a junction at which the integral tongue elements 42*a*, 42*b* are joined together. In aspects, the connection 56 can bisect part or substantially all of the tongue 54 and/or the throat portion 34. In some aspects, the connection 56 extends substantially along a centerline of the upper 22, e.g., like the centerline 35 in FIG. 2. In some aspects, the connection 56 is at least partially offset from a centerline of the upper 22, e.g., the centerline 35 in FIG. 2. For example, in aspects, the connection 56 can be at least partially offset towards the side portion 26 and/or the side portion 28.

The integral tongue elements 42*a*, 42*b* can be joined together at the connection 56 using different methods. For example, in aspects, the connection 56 can be stitched, e.g., such that at least one line of stitching joins the integral tongue elements 42*a*, 42*b* to each other at the connection 56. In aspects, a linear stitch and/or a non-linear stitch, e.g., a zig-zag stitch, can be used to join the integral tongue elements 42*a*, 42*b* together at the connection 56. Other methods can be used to attach the integral tongue elements 42*a*, 42*b* at the connection 56. For example, in aspects, the integral tongue elements 42*a*, 42*b* can be attached with adhesives, bonding, welding (e.g., high-frequency welding or ultrasonic welding), thermoforming fusible materials incorporated into and/or between the integral tongue elements 42*a*, 42*b*, and/or by using another suitable material joining and/or attachment method. In some aspects, the integral tongue elements 42*a*, 42*b* can be overlapped with each other and then secured, and/or can be rolled together and then secured. In some aspects, an overlay and/or backing can be attached at the connection 56 (e.g., on an inner surface thereof, an outer surface thereof, or both) to facilitate securing the integral tongue elements 42*a*, 42*b* together. In some aspects, the connection 56 can be secured through embroidering.

Looking now at FIG. 4A, a bitmap 60 corresponding to the radially knitted component 20 shown in FIG. 2 is provided, in accordance with aspects of the present disclosure. The bitmap 60 represents the configuration of the radially knitted component 20 as it is produced during a knitting operation performed on a knitting machine, e.g., a programmable knitting machine, as opposed to the configuration of the radially knitted component 20 once produced and in a flat resting position, e.g., as shown in FIG. 2.

During a knitting operation, a plurality of knitted courses 36 are formed by the knitting machine according to the configuration of the bitmap 60. This includes knitted courses 36*a*, 36*b*, 36*c*, among others. The knitting machine knits the knitted courses 36, e.g., by forming a sequence of knitted loops, along the knitting axis (K), as indicated in FIG. 4A. The formation of knitted courses 36 produces the radially knitted component 20 along the production direction (P), as indicated in FIG. 4A. To form the non-linear shape of the resulting knitted component 20, the radially knitted courses 36 are formed by knitting a series of wedges. Knitting wedges entails knitting a series of sequentially longer and sequentially shorter knitted courses in repeating fashion, e.g., as shown by the different length knitted courses 36 extending between the perimeter edges 38, 40 along the knitting axis (K), as shown in FIG. 4A. The knitting of longer and shorter courses in a repeating sequence produces the wedges that cause the radially knitted component 20 to adopt a non-linear shape subsequent to formation. For example, as shown in FIG. 2, the upper 22 forms a substantially curved or arcuate shape due to the wedges included between ends 45*a*, 45*b* of the bitmap 60. The angular shape of the knitted component 20 produced by the knitting machine can be adjusted or modified by changing the geometry of the wedges that are knitted by the knitting machine according to the bitmap.

Looking at FIG. 4A, sections of the bitmap 60 corresponding to parts of the upper 22 in FIG. 2 are identified. For example, knitted courses 36 corresponding to the heel portion 30 form part of the bitmap 60; knitted courses corresponding to the side portion 28 form part of the bitmap 60; knitted courses corresponding to the toe portion 24 form part of the bitmap 60; and knitted courses 36 corresponding to the side portion 26 form part of the bitmap 60. Each portion 24, 26, 28, 30 of the knitted component 20 includes a corresponding sequence of knitted courses 36 of transitioning length extending between the inner perimeter edge 38 and the outer perimeter edge 40. The bitmap 60 also depicts the integral tongue elements 42*a*, 42*b* that are an integrally formed part of the knitted component 20. In FIG. 4A, it can be seen that parts of the bitmap 60 corresponding to the integral tongue elements 42*a*, 42*b* include radially knitted courses 36 that are increased in length, or in other words, in the parts of the bitmap 60 corresponding to the integral tongue elements 42*a*, 42*b*, the inner perimeter edge 38 and the outer perimeter edge 40 are spaced apart a greater distance. These lengthened but still integrally knitted courses 36 are shaped to extend and thus form the integral tongue elements 42*a*, 42*b* as identified in FIG. 2. The courses 36 corresponding to the integral tongue elements 42*a*, 42*b* are formed, such that in a flat configuration, the integral tongue elements 42*a*, 42*b* at least partially intersect and/or overlap with each other, e.g., as shown in FIG. 2.

Looking still at FIG. 4A, a line 72*a* and a line 72*b* are depicted. Line 72*a* corresponds to a location and shape of the throat edge or side 34*a*, as depicted in FIG. 2. Line 72*b* corresponds to a location and shape of the throat edge or side 34*b*, as depicted in FIG. 2. If the radially knitted component 20 is knitted without the integral tongue elements 42*a*, 42*b*, the inner edges could instead terminate at the lines 72*a*, 72*b*. This could provide a knitted component suitable for attachment of a separate tongue in a post-processing operation. If the radially knitted component 20 is produced with the integral tongue elements 42*a*, 42*b* that are defined at least in part by the inner perimeter edges 38*a*, 38*b* as shown in the bitmap 60, the tongue elements 42*a*, 42*b* can then, e.g., in a post-processing operation, be joined together at connection 56 to form a tongue 54 that is at least partially integrally formed with a remainder of the knitted component 20. Looking at the bitmap 60, and the corresponding knitted component 20, it can be seen that the inner perimeter edge 38*a* of integral tongue element 42*a* has a generally convex contour or outwardly-curved shape (that can be changed based on the configuration of the bitmap 60), inner perimeter edge 38*b* of integral tongue element 42*b* has a generally convex contour or outwardly-curved shape (that can be changed based on the configuration of the bitmap 60), and inner perimeter edge 38*c* between the inner perimeter edges 38*a*, 38*b* has a generally concave contour and/or inwardly-curved shape and/or recessed shape (that can be changed based on the configuration of the bitmap 60). This is also reflected by the flat shape of the knitted component 20 as shown in FIG. 2. In aspects, by changing the slope of the inner perimeter edges 38*a*, 38*b*, 38*c*, the resulting geometry of the tongue and knitted component 20 can be modified. To form the assembled and dimensional tongue 54, the inner perimeter edges 38*a* and 38*b* can be attached together, thereby forming the connection 56 that extends generally from a collar portion 32, along the inner perimeter edges 38*a*, 38*b*, and to the inner perimeter edge 38*c*.

In some aspects, a bitmap—such as the bitmap 60—may be modified to alter the geometry of the resulting knitted component. For example, as illustrated by bitmap 65 in FIG.

4B, the length of knitted courses in the heel region 30 of knitted component 21 is extended compared to the knitted component 20. This extension results in a longer, larger, and/or taller ankle cuff or bootie 55. The increased height of the ankle cuff or bootie 55 can enhance protection, comfort, and stability for a wearer, while maintaining an integrally knit construction similar to the knitted component 20. Additionally, the length of knitted courses forming integral tongue elements—such as integral tongue elements 42*c*, 42*d* shown in FIG. 4B—can be adjusted accordingly to align with the taller ankle cuff or bootie, e.g., as shown with the knitted component 21 in FIG. 4B. The knitted courses may be extended by any desired distance(s) to achieve a desired ankle cuff or bootie height and/or geometry. The knitted component 21 and bitmap 65 are intended to represent only one non-limiting, alternative example, and others are possible.

FIG. 4A and FIG. 4B each depict a shape of the corresponding integral tongue elements 42*a*, 42*b* and 42*c*, 42*d* defined by their combination of knitted courses 36 having particular lengths between perimeter edges 38, 40. However, this is intended to represent only one non-limiting example and other configurations and combinations of slopes, length of knitted courses, and/or shapes are contemplated herein.

Figure 5:
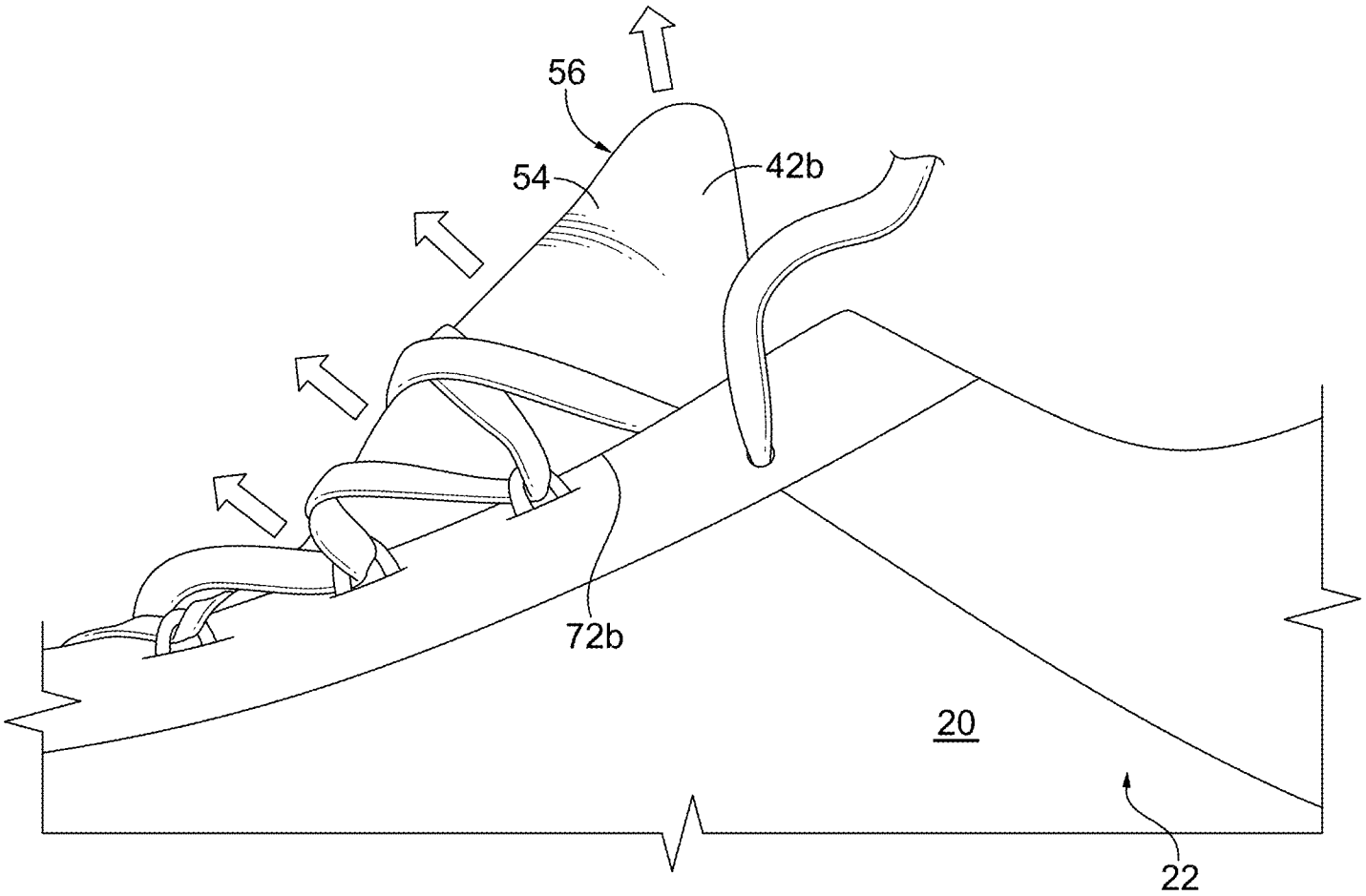
FIG. 5 is a lateral depiction of the article of footwear of FIGS. 3A and 3B, depicting how the integral tongue elements being connected together can produce a dimensional tongue structure, in accordance with aspects of the present disclosure.

Looking now at FIG. 5, a lateral depiction of the article of footwear 50 showing the tongue 54 formed from the integral tongue elements 42*a*, 42*b* being attached together at the connection 56 is provided, in accordance with aspects of the present disclosure. The shape of integral tongue elements described herein can produce a tongue structure with enhanced and beneficial properties. For example, by forming integral tongue elements, e.g., integral tongue elements 42*a*, 42*b* produced according to the bitmap 60, that in a flat configuration intersect and/or overlap with each other, the resulting tongue 54 can unexpectedly have a more desirable shape, position, and dimensional characteristics. For example, in instances where a tongue portion is attached in a post-knitting process, the tongue being not integrally constructed as in FIGS. 2, 4, and 5 can at least partially contract, compact, collapse, or otherwise not effectively maintain the tongue's dimensional characteristics. However, by forming a radially knitted component with integral tongue elements of an extended dimension and geometry, e.g., as shown in FIG. 2 and in FIGS. 4A and 4B, the tongue 54 can unexpectedly produce a more protruded, expanded, or outwardly-curved shape that sustains a more desirable shape, aesthetic, and wearability, as indicated by the arrows in FIG. 5.

In aspects, forming a knit upper with radially knitted courses, such that in a flat configuration, tongue elements of the knit upper at least partially overlap each other, allows for a unique transformation once the tongue elements are attached together. Initially, the overlapping tongue elements may lie substantially flat, e.g., at least partially over/under each other. Once the tongue elements are attached together—typically through stitching, bonding, adhesives, and/or another attachment method—in a mid-throat area and/or proximate a longitudinal centerline thereof, the integration produces dimensional shape, contour, protrusion, and/or curvature. This helps support desired shaping and also allows the tongue to more readily adopt the shape of a wearer's foot.

Figure 6A:
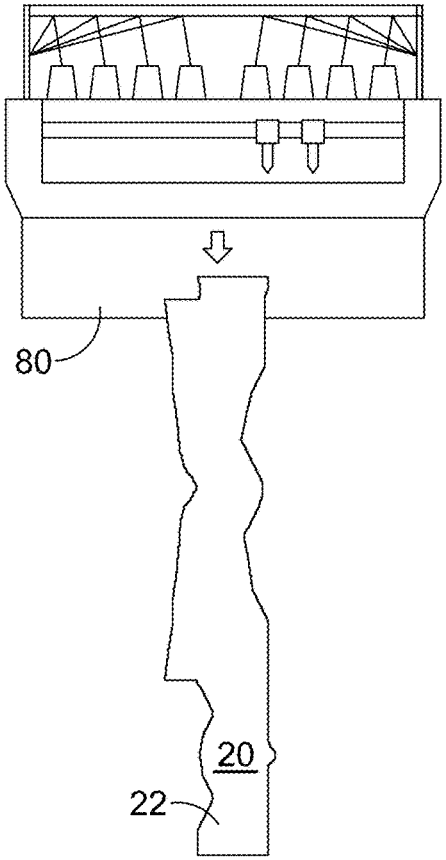
FIGS. 6A-6D depict an example process of producing a radially knitted component for an upper, connecting integral tongue elements together to form a tongue, and incorporating the upper into an article of footwear, in accordance with aspects of the present disclosure.
Figure 6B:
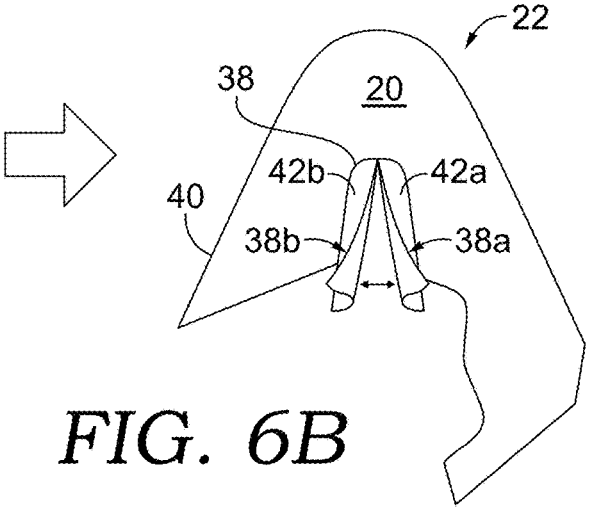
Figure 6C:
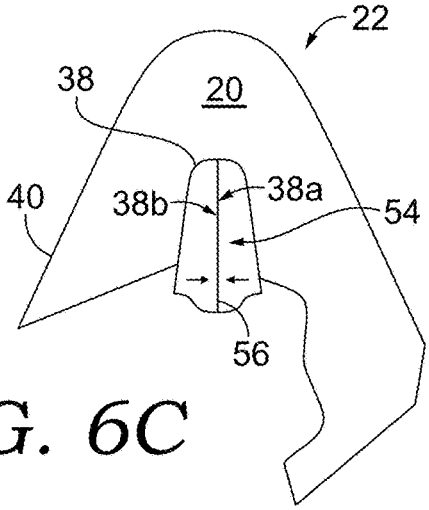
Figure 6D:
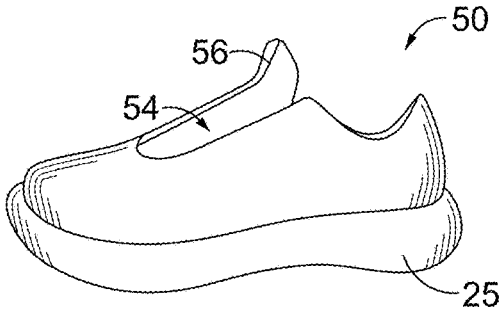

Looking now at FIGS. 6A-6D, an example process of producing a radially knitted component for an upper, connecting integral tongue elements together to form a tongue, and incorporating the upper into an article of footwear, is shown, in accordance with aspects of the present disclosure. For the purposes of explanation, the radially knitted component 20 and upper 22 of FIG. 2 is referenced in connection with the process depicted in FIGS. 6A-6D. However, many other configurations of radially knitted components can be produced and integrated into an article of footwear using the process described in connection with FIGS. 6A-6D. FIG. 6A shows the knitted component 20 being produced by a knitting machine 80 according to the bitmap 60 of FIG. 4A (or alternatively the bitmap 65 of FIG. 4B). FIG. 6B shows the knitted component 20 once it is produced by the knitting machine 80, and in a flat configuration, e.g., as in FIG. 2, with inner perimeter edges 38*a*, 38*b* of integral tongue elements 42*a*, 42*b* displaced, e.g., not yet connected together in a post-knitting process. In FIG. 6C, the inner perimeter edges 38*a*, 38*b* corresponding to the distal edges of the integral tongue elements 42*a*, 42*b* have been attached together, e.g., via stitching, bonding, welding, and/or via another method. This forms the dimensional tongue 54 that is at least partially integrally formed with the radially knitted component 20 other than the connection 56. In FIG. 6D, the upper 22 with the radially knitted component 20 and tongue 54 is incorporated into an article of footwear 50 through attaching the upper to a sole structure 25. In aspects, a higher ankle collar or bootie may be incorporated into the article of footwear 50, e.g., by using knitted component 21 associated with FIG. 4B instead of knitted component 20 associated with FIG. 4A. The example described in connection with FIGS. 6A-6D may include additional or alternative processes. In addition, the processes described in connection with FIGS. 6A-6D can be performed in a different order. For example, the attachment of the inner perimeter edges 38*a*, 38*b* to form the connection 56 can occur before and/or after incorporating the upper 22 at least partially into the article of footwear 50 (e.g., before or after attaching the upper 22 to the sole structure 25).

Figure 7:
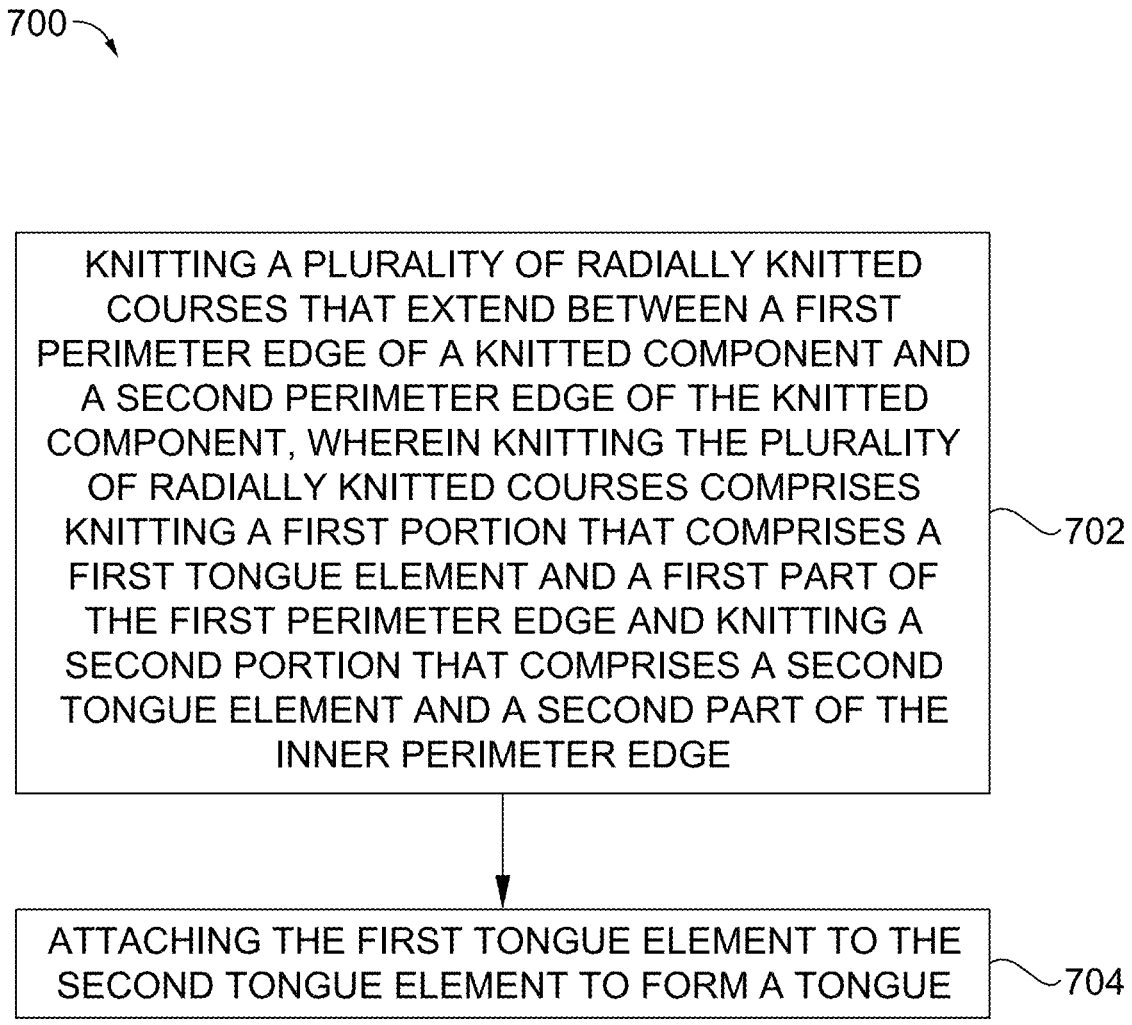
FIG. 7 is a block diagram of method of manufacturing an article of footwear, in accordance with aspects herein.

Looking now at FIG. 7, a block diagram of a method 700 of manufacturing a knitted component for footwear, e.g., the knitted component 20 of FIG. 2, is shown, in accordance with aspects of the present disclosure. The method 700 includes blocks 702-704 but is not limited to this selection of elements or the order represented. In block 702, the method 700 includes knitting a plurality of radially knitted courses, e.g., radially knitted courses 36 in FIG. 2, that extend between a first perimeter edge, e.g., the inner perimeter edge 38 in FIG. 2, of the knitted component and a second perimeter edge, e.g., the outer perimeter edge 40 in FIG. 2, of the knitted component. In aspects, knitting the plurality of radially knitted courses comprises knitting a first portion that comprises a first tongue element, e.g., tongue element 42*a* of FIG. 2, comprising a first part of the inner perimeter edge, e.g., inner perimeter edge 38*a*, and knitting a second portion that comprises a second tongue element, e.g., tongue element 42*b* of FIG. 2, comprising a second part of the inner perimeter edge. In block 704, the method 700 includes attaching the first tongue element to the second tongue element to form a tongue, e.g., the tongue 54 shown in FIGS. 3A and 3B.

The term "article of footwear" as used herein refers to one that generally includes a sole structure secured to an upper. The articles of footwear described herein may comprise a running shoe, a baseball shoe, a basketball shoe, a skateboarding shoe, a cycling shoe, an American football shoe, a tennis shoe, a global football shoe, a training shoe, a walking shoe, a hiking shoe, and the like. The concepts described herein may also be applied to other footwear types that are considered non-athletic such as dress shoes, loafers, sandals, casual shoes, and work boots. As used herein, the article of footwear may be divided into different general regions. A forefoot region generally includes portions of the article of footwear that correspond to the toes and joints connecting the metatarsals with the phalanges. A midfoot region generally includes portions of the article of footwear corresponding with an arch area and an instep area of the foot. A heel region generally corresponds with rear portions of the foot including the calcaneus bone. The article of footwear described herein may include a lateral side which corresponds with an outside area of the foot (e.g., the surface that faces away from the other foot) and a medial side which corresponds with an inside area of the foot (e.g., the surface that faces toward the other foot). The different regions and sides described above are intended to represent general areas of footwear to aid in the following discussion and are not intended to demarcate precise areas. The different regions and sides may be applied to the article of footwear as a whole, to the upper, and to the sole structure.

The term "knit element" or "knitted component" as used herein, refers to a textile piece that is formed from at least one yarn that is manipulated (e.g., with a knitting machine) to form a plurality of intermeshed loops (also known as interlooping) that define courses and wales. The term "course," as used herein, refers to a predominantly horizontal row of knit loops (in an upright textile as it is knit on the knitting machine) that is produced by adjacent needles during the same knitting process. The course may comprise one or more stitch types, such as a knit stitch, a missed stitch, a tuck stitch, a transfer stitch, a rib stitch, and the like, as these terms are known in the art of knitting. The term "course-wise direction" refers to a direction that is parallel to the knit courses of the textile piece. The term "wale," as used herein, is a predominantly vertical column of intermeshed or interlooped knit loops, generally produced by the same needle at successive (but not necessarily all) courses or knitting cycles. The term "wale-wise direction" refers to a direction that is parallel to the knit wales of the textile piece.

The term "double knit construction," as used herein, refers to a knit construction that is generally formed on at least two needle beds of a knitting machine (e.g., a multi-bed construction). These multi-bed knit constructions may have two opposing layers of knit loops and/or tucks, e.g., one layer of loops formed on a first needle bed (e.g., a first knit layer), and a second layer of loops formed on a second needle bed (e.g., a second knit layer). In example aspects, the two layers may be joined by yarns that interloop with yarns in both the first knit layer and the second knit layer of the double knit construction. Common double knit constructions include double jersey, rib, interlock, cardigan, and other "double bed" knit structures initially formed on at least two needle beds, and other knit structures having two opposing faces or layers of knit loops or tucks, including full-gauge and less than full-gauge, e.g., half-gauge, variations of those structures.

The term "integrally knit," as used herein, may refer to a knit textile having a yarn from one or more knit courses in a first area or zone being interlooped with one or more knit courses of another area or zone (e.g., first knit zone and second knit zone). The interlooping may be through a simple knit stitch, a tuck stitch, a held stitch, a float or miss stitch, or the like. In this way, areas or zones that are integrally knit together can have a generally seamless transition such that the areas or zones seamlessly extend from one another.

The term "thermoformed," as used herein, refers to a process of applying heat and/or energy to a fusible material such that it melts, flows, and then re-solidifies and hardens upon cooling into a new shape or geometry. Thus, in aspects, a thermoformed area may include the same polymeric material as a thermoplastic material that forms part of low-melting yarns incorporated into knitted components described herein.

The term "outer-facing surface" as used herein refers to a surface of a knit element, an upper, or an article of footwear that faces the external environment. In some aspects, the outer-facing surface can mean the outermost-facing surface of the knit element, the upper, or the article of footwear.

The term "inner-facing surface" as used herein refers to a surface of the knit element, the upper, or the article of footwear that faces a void for receiving the wearer's foot. In some aspects, the inner-facing surface may refer to the innermost-facing surface of the knit element, the upper, or the article of footwear.

Unless indicated otherwise, all measurements provided herein are taken when the knit element, the upper, and/or the article of footwear are at standard ambient temperature and pressure (298.15 K and 100 kPa) and is in a resting (non-tensioned) state. In addition, as used herein, the term "about" means within ±10% of an indicated value.

Clause 1. A knitted component, comprising: an inner perimeter edge; an outer perimeter edge; a plurality of radially knitted courses extending from the inner perimeter edge to the outer perimeter edge; a first tongue element integrally knitted with the plurality of radially knitted courses and comprising a first part of the inner perimeter edge; and a second tongue element integrally knitted with the plurality of radially knitted courses and comprising a second part of the inner perimeter edge, wherein the first tongue element and the second tongue element are configured to be coupled together to form at least part of a tongue.

Clause 2. The knitted component of clause 1, wherein the first tongue element and the second tongue element comprise an integrally knitted structure.

Clause 3. The knitted component of clause 1 or 2, wherein, when the knitted component is positioned in a flat configuration, the first tongue element and the second tongue element are overlapping.

Clause 4. The knitted component of any of clauses 1-3, wherein the first part of the inner perimeter edge comprises a convex contour, wherein the second part of the inner perimeter edge comprises a convex contour, and wherein a third part of the inner perimeter edge is located between the first part of the inner perimeter edge and the second part of the inner perimeter edge and comprises a concave contour.

Clause 5. The knitted component of any of clauses 1-4, wherein the knitted component comprises at least part of an upper of an article of footwear.

Clause 6. An upper for footwear, comprising: a knitted component, comprising: an inner perimeter edge; an outer perimeter edge; a plurality of radially knitted courses extending from the inner perimeter edge to the outer perimeter edge; a first tongue element integrally knitted with the plurality of radially knitted courses and comprising a first part of the inner perimeter edge; and a second tongue element integrally knitted with the plurality of radially knitted courses and comprising a second part of the inner perimeter edge, wherein the first tongue element and the second tongue element are configured to be coupled together to form at least part of a tongue of the upper.

Clause 7. The upper of clause 6, wherein the first tongue element and the second tongue element comprise an integrally knitted structure.

Clause 8. The upper of clause 6 or 7, wherein, when the knitted component is positioned in a flat configuration, the first tongue element and the second tongue element are overlapping.

Clause 9. The upper of any of clauses 6-8, wherein the first part of the inner perimeter edge is located on a first side of the upper, and wherein the second part of the inner perimeter edge is located on a second side of the upper, and wherein the first tongue element and the second tongue element extend towards each other.

Clause 10. The upper of any of clauses 6-9, wherein a third part of the inner perimeter edge is located between the first part of the inner perimeter edge and the second part of the inner perimeter edge and defines a recessed shape.

Clause 11. An upper for footwear, comprising: a knitted component, comprising: an inner perimeter edge; an outer perimeter edge; a plurality of radially knitted courses extending from the inner perimeter edge to the outer perimeter edge; a first tongue element integrally formed with a first side of the knitted component and comprising a first part of the inner perimeter edge; and a second tongue element integrally formed with a second side of the knitted component and comprising a second part of the inner perimeter edge, wherein the first tongue element and the second tongue element are configured to be coupled together to form at least part of a tongue.

Clause 12. The upper of clause 11, wherein the first tongue element and the second tongue element comprise an integrally knitted structure.

Clause 13. The upper of clause 11 or 12, wherein the first tongue element comprises a first portion of the plurality of radially knitted courses and the second tongue element comprises a second portion of the plurality of radially knitted courses.

Clause 14. The upper of any of clauses 11-13, wherein the knitted component comprises a plurality of knitted pieces connected together, each knitted piece comprising a portion of the plurality of radially knitted courses.

Clause 15. An article of footwear, comprising: an upper, comprising: a knitted component, comprising: an inner perimeter edge; an outer perimeter edge; a plurality of radially knitted courses extending from the inner perimeter edge to the outer perimeter edge; a first tongue element integrally knitted with the plurality of radially knitted courses and comprising a first part of the inner perimeter edge; and a second tongue element integrally knitted with the plurality of radially knitted courses and comprising a second part of the inner perimeter edge, wherein the first tongue element and the second tongue element are attached together, forming at least part of a tongue of the upper; and a sole structure attached to the upper.

Clause 16. The article of footwear of clause 15, wherein the upper comprises an exterior-facing surface and an interior-facing surface, and wherein the first tongue element and the second tongue element are formed and attached such that the tongue projects at least partially outward from the exterior-facing surface.

Clause 17. The article of footwear of clause 15 or 16, wherein the first tongue element and the second tongue element are attached together with at least a line of stitching.

Clause 18. The article of footwear of any of clauses 15-17, wherein the line of stitching comprises a zig-zag stitch.

Clause 19. The article of footwear of any of clauses 15-18, wherein the first tongue element and the second tongue element are attached together in an overlapping configuration.

Clause 20. The article of footwear of any of clauses 15-19, wherein the overlapping configuration comprises a rolled configuration of the first tongue element and the second tongue element.

Clause 21. An article of footwear, comprising: an upper, comprising: a knitted component, comprising: an inner perimeter edge; an outer perimeter edge; a plurality of radially knitted courses extending from the inner perimeter edge to the outer perimeter edge; a first tongue element integrally formed with a first side of the knitted component and comprising a first part of the inner perimeter edge; and a second tongue element integrally formed with a second side of the knitted component and comprising a second part of the inner perimeter edge, wherein the first tongue element and the second tongue element are attached together, forming at least part of a tongue of the upper; and a sole structure attached to the upper.

Clause 22. The article of footwear of clause 21, wherein the first tongue element and the second tongue element comprise an integrally knitted structure.

Clause 23. The article of footwear of clause 21 or 22, wherein the first tongue element comprises a first portion of the plurality of radially knitted courses and the second tongue element comprises a second portion of the plurality of radially knitted courses.

Clause 24. The article of footwear of any of clauses 21-23, wherein the knitted component comprises a plurality of knitted pieces connected together, each knitted piece comprising a portion of the plurality of radially knitted courses.

Clause 25. The article of footwear of any of clauses 21-24, wherein the first tongue element and the second tongue element through being attached together form a dimensional shape that at least partially projects outward from the article of footwear.

Clause 26. The article of footwear of any of clauses 21-25, wherein, when the knitted component is in a flat configuration, the first tongue element and the second tongue element, through being attached together, form a dimensional shape while a remainder of the knitted component remains substantially flat.

Clause 27. A method of manufacturing a knitted component for footwear, the method comprising: knitting a plurality of radially knitted courses that extend between a first perimeter edge of the knitted component and a second perimeter edge of the knitted component, wherein knitting the plurality of radially knitted courses comprises: knitting a first portion that comprises a first tongue element and a first part of the first perimeter edge, and knitting a second portion that comprises a second tongue element and a second part of the first perimeter edge; and attaching the first tongue element to the second tongue element to form a tongue.

Clause 28. The method of manufacturing of clause 27, wherein the first portion and the second portion comprise an integrally knitted structure.

Clause 29. The method of manufacturing of clause 27 or 28, wherein the first portion and the second portion comprise separately knitted structures.

In some aspects, this disclosure may include the language, for example, "at least one of [element A] and [element B]." This language may refer to one or more of the elements. For example, "at least one of A and B" may refer to "A," "B," or "A and B." In other words, "at least one of A and B" may refer to "at least one of A and at least one of B," or "at least either of A or B." In some aspects, this disclosure may include the language, for example, "[element A], [element B], and/or [element C]." This language may refer to either of the elements or any combination thereof. In other words, "A, B, and/or C" may refer to "A," "B," "C," "A and B," "A and C," "B and C," or "A, B, and C." In addition, this disclosure may use the term "and/or" which may refer to any one or combination of the associated elements. In addition, this disclosure may use the term "a" (element) or "the" (element). This language may refer to the referenced element in the singular or in the plural and is not intended to be limiting in this respect.

The subject matter of this disclosure has been described in relation to particular aspects, which are intended in all respects to be illustrative rather than restrictive. In this sense, alternative aspects will become apparent to those of ordinary skill in the art to which the present subject matter pertains without departing from the scope hereof. In addition, different combinations and sub-combinations of elements disclosed, as well as use and inclusion of elements not shown, are possible and contemplated as well.

This detailed description is provided in order to meet statutory requirements. However, this description is not intended to limit the scope of the invention described herein. Rather, the claimed subject matter may be embodied in different ways, to include different steps, different combinations of steps, different elements, and/or different combinations of elements, similar to those described in this disclosure, and in conjunction with other present or future technologies or solutions. Moreover, although the terms "step" or "block" may be used herein to identify different elements of methods employed, the terms should not be interpreted as implying any particular order among or between different elements except when the order is explicitly stated.

What is claimed is:

1. A knitted component, comprising:
an inner perimeter edge;
an outer perimeter edge;
a plurality of radially knitted courses extending from the inner perimeter edge to the outer perimeter edge;
a first tongue element integrally knitted with the plurality of radially knitted courses and comprising a first part of the inner perimeter edge; and
a second tongue element integrally knitted with the plurality of radially knitted courses and comprising a second part of the inner perimeter edge, wherein the first tongue element and the second tongue element are configured to be coupled together to form at least part of a tongue.

2. The knitted component of claim 1, wherein the first tongue element and the second tongue element comprise an integrally knitted structure.

3. The knitted component of claim 1, wherein, when the knitted component is positioned in a flat configuration, the first tongue element and the second tongue element are overlapping.

4. The knitted component of claim 1, wherein the first part of the inner perimeter edge comprises a convex contour, wherein the second part of the inner perimeter edge comprises a convex contour, and wherein a third part of the inner perimeter edge is located between the first part of the inner perimeter edge and the second part of the inner perimeter edge and comprises a concave contour.

5. The knitted component of claim 1, wherein the knitted component comprises at least part of an upper of an article of footwear.

6. An upper for footwear, comprising:
a knitted component, comprising:
an inner perimeter edge;
an outer perimeter edge;
a plurality of radially knitted courses extending from the inner perimeter edge to the outer perimeter edge;
a first tongue element integrally knitted with the plurality of radially knitted courses and comprising a first part of the inner perimeter edge; and
a second tongue element integrally knitted with the plurality of radially knitted courses and comprising a second part of the inner perimeter edge, wherein the first tongue element and the second tongue element are configured to be coupled together to form at least part of a tongue of the upper.

7. The upper of claim 6, wherein the first tongue element and the second tongue element comprise an integrally knitted structure.

8. The upper of claim 6, wherein, when the knitted component is positioned in a flat configuration, the first tongue element and the second tongue element are overlapping.

9. The upper of claim 6, wherein the first part of the inner perimeter edge is located on a first side of the upper, and wherein the second part of the inner perimeter edge is located on a second side of the upper, and wherein the first tongue element and the second tongue element extend towards each other.

10. The upper of claim 6, wherein a third part of the inner perimeter edge is located between the first part of the inner perimeter edge and the second part of the inner perimeter edge and defines a recessed shape.

11. An upper for footwear, comprising:
a knitted component, comprising:
an inner perimeter edge;
an outer perimeter edge;
a plurality of radially knitted courses extending from the inner perimeter edge to the outer perimeter edge;
a first tongue element integrally formed with a first side of the knitted component and comprising a first part of the inner perimeter edge; and
a second tongue element integrally formed with a second side of the knitted component and comprising a second part of the inner perimeter edge, wherein the first tongue element and the second tongue element are configured to be coupled together to form at least part of a tongue.

12. The upper of claim 11, wherein the first tongue element and the second tongue element comprise an integrally knitted structure.

13. The upper of claim 12, wherein the first tongue element comprises a first portion of the plurality of radially knitted courses and the second tongue element comprises a second portion of the plurality of radially knitted courses.

14. The upper of claim 11, wherein the knitted component comprises a plurality of knitted pieces connected together, each knitted piece comprising a portion of the plurality of radially knitted courses.

15. An article of footwear, comprising:
an upper, comprising:
a knitted component, comprising:
an inner perimeter edge;
an outer perimeter edge;
a plurality of radially knitted courses extending from the inner perimeter edge to the outer perimeter edge;
a first tongue element integrally knitted with the plurality of radially knitted courses and comprising a first part of the inner perimeter edge; and a second tongue element integrally knitted with the plurality of radially knitted courses and comprising a second part of the inner perimeter edge, wherein the first tongue element and the second tongue element are attached together, forming at least part of a tongue of the upper; and a sole structure attached to the upper.

16. The article of footwear of claim 15, wherein the upper comprises an exterior-facing surface and an interior-facing surface, and wherein the first tongue element and the second tongue element are formed and attached such that the tongue projects at least partially outward from the exterior-facing surface.

17. The article of footwear of claim 15, wherein the first tongue element and the second tongue element are attached together with at least a line of stitching.

18. The article of footwear of claim 17, wherein the line of stitching comprises a zig-zag stitch.

19. The article of footwear of claim 15, wherein the first tongue element and the second tongue element are attached together in an overlapping configuration.

20. The article of footwear of claim 19, wherein the overlapping configuration comprises a rolled configuration of the first tongue element and the second tongue element.

21. An article of footwear, comprising:

an upper, comprising:

a knitted component, comprising:

an inner perimeter edge;

an outer perimeter edge;

a plurality of radially knitted courses extending from the inner perimeter edge to the outer perimeter edge;

a first tongue element integrally formed with a first side of the knitted component and comprising a first part of the inner perimeter edge; and a second tongue element integrally formed with a second side of the knitted component and comprising a second part of the inner perimeter edge, wherein the first tongue element and the second tongue element are attached together, forming at least part of a tongue of the upper; and a sole structure attached to the upper.

22. The article of footwear of claim 21, wherein the first tongue element and the second tongue element comprise an integrally knitted structure.

23. The article of footwear of claim 22, wherein the first tongue element comprises a first portion of the plurality of radially knitted courses and the second tongue element comprises a second portion of the plurality of radially knitted courses.

24. The article of footwear of claim 21, wherein the knitted component comprises a plurality of knitted pieces connected together, each knitted piece comprising a portion of the plurality of radially knitted courses.

25. The article of footwear of claim 21, wherein the first tongue element and the second tongue element via being attached together form a dimensional shape that at least partially projects outward from the article of footwear.

26. The article of footwear of claim 21, wherein, when the knitted component is in a flat configuration, the first tongue element and the second tongue element, through being attached together, form a dimensional shape while a remainder of the knitted component remains substantially flat.

27. A method of manufacturing a knitted component for footwear, the method comprising:

knitting a plurality of radially knitted courses that extend between a first perimeter edge of the knitted component and a second perimeter edge of the knitted component, wherein knitting the plurality of radially knitted courses comprises:

knitting a first portion that comprises a first tongue element and a first part of the first perimeter edge, and knitting a second portion that comprises a second tongue element and a second part of the first perimeter edge; and attaching the first tongue element to the second tongue element to form a tongue.

28. The method of manufacturing of claim 27, wherein the first portion and the second portion comprise an integrally knitted structure.

29. The method of manufacturing of claim 27, wherein the first portion and the second portion comprise separately knitted structures.

* * * * *